US008151810B2

(12) United States Patent
House et al.

(10) Patent No.: US 8,151,810 B2
(45) Date of Patent: Apr. 10, 2012

(54) BASKET ASSEMBLY FOR A DISHWASHER, AND ASSOCIATED APPARATUS

(75) Inventors: David E. House, Greenville, NC (US); Kyle Taylor Perkinson, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 579 days.

(21) Appl. No.: 12/365,645

(22) Filed: Feb. 4, 2009

(65) Prior Publication Data

US 2010/0194254 A1 Aug. 5, 2010

(51) Int. Cl.
*B08B 3/02* (2006.01)

(52) U.S. Cl. ..... 134/135; 211/41.2

(58) Field of Classification Search ..... 134/135; 211/41.2

See application file for complete search history.

(56) References Cited

U.S. PATENT DOCUMENTS

| | | | | | |
|---|---|---|---|---|---|
| 2,854,167 | A | * | 9/1958 | King | 220/610 |
| 2,994,453 | A | * | 8/1961 | Gardiner | 220/825 |
| D254,187 | S | * | 2/1980 | Freese | D32/3 |
| 4,649,813 | A | * | 3/1987 | Kehl | 100/227 |
| 4,776,478 | A | * | 10/1988 | Miller et al. | 220/254.5 |
| 4,974,746 | A | * | 12/1990 | Dickinson | 220/495.09 |
| D321,576 | S | * | 11/1991 | Hradisky | D34/8 |
| 5,085,342 | A | * | 2/1992 | Strawder | 220/495.09 |
| 5,287,984 | A | | 2/1994 | Michael | |
| 5,407,089 | A | * | 4/1995 | Bird et al. | 220/212.5 |
| 5,431,294 | A | * | 7/1995 | Stottmann et al. | 220/23.4 |
| D391,696 | S | * | 3/1998 | Bournay et al. | D32/3 |
| 6,199,862 | B1 | * | 3/2001 | Long et al. | 273/148 R |
| D487,825 | S | | 3/2004 | Kim et al. | |
| D488,891 | S | * | 4/2004 | Smith et al. | D32/3 |
| D502,295 | S | | 2/2005 | Feddema | |
| D517,253 | S | * | 3/2006 | Raches et al. | D32/3 |
| 7,383,846 | B2 | * | 6/2008 | Curran | 134/135 |
| 2005/0242046 | A1 | | 11/2005 | Lee | |
| 2007/0039971 | A1 | | 2/2007 | Purushothaman | |
| 2008/0272126 | A1 | | 11/2008 | Crookshanks et al. | |

FOREIGN PATENT DOCUMENTS

| | | | |
|---|---|---|---|
| EP | 1 256 309 B1 | | 2/2004 |
| EP | 1 859 722 A1 | | 11/2007 |
| JP | 03-256874 | * | 11/1991 |
| KR | 2006085977 | * | 7/2006 |
| KR | 2007062295 | * | 6/2007 |

OTHER PUBLICATIONS

WIPO WO 2006/063899 Jun. 2006.*

* cited by examiner

*Primary Examiner* — Frankie L Stinson
(74) *Attorney, Agent, or Firm* — Alston & Bird LLP

(57) ABSTRACT

A basket assembly for holding items such as silverware and the like in a dishwashing appliance is provided. The dishwashing appliance has a rack member movable into and out of a tub portion, wherein the basket assembly is received and supported by the rack member. The basket assembly comprises a plurality of wall members cooperating to form a compartment defining a compartment opening. A lid member is coupled to the compartment about the compartment opening. The lid member defines a lid plane and is configured to be pivotable about a pivot axis, disposed medially across the lid member and extending along the lid plane, between a first position with the lid member extending across the compartment opening, and a second position with the lid member extending substantially perpendicularly to the compartment opening. An associated apparatus is also provided.

19 Claims, 5 Drawing Sheets

BASKET ASSEMBLY FOR A DISHWASHER, AND ASSOCIATED APPARATUS

BACKGROUND OF THE INVENTION

1. Field of the Invention

Embodiments of the present invention relate to dishwashing appliances and, more particularly, to a basket assembly for holding items such as silverware and the like in a dishwasher, and an apparatus associated therewith.

2. Description of Related Art

A dishwasher generally includes a tub defining an enclosure for receiving kitchenware to be washed. Such a dishwasher generally includes dish racks defined by a lattice structure adapted to hold kitchenware items such as dishes, plates, glasses, cups, pots and pans for washing within the tub. The dish racks typically are configured to be movable into and out of the tub of the dishwasher so as to facilitate loading and unloading of the kitchenware items. At least one of the dish racks normally has a silverware basket assembly mounted to or formed therein for holding knives, forks and spoons. For example, dishwashers typically include a lower dish rack configured to receive and accommodate various forms of "silverware baskets."

Often times, the aim of such silverware baskets is to provide the largest and most usable configuration that will reasonably fit in the lower dish rack while allowing sufficient space for accommodating other dishware and cookware. In some instances, in order to make the lower dish rack as large as possible, the forward edge of the lower dish rack may include chamfers extending from the side walls of the lower dish rack and converging toward a front wall of the lower dish rack. In this manner, the "narrowed" front wall of the lower dish rack may be configured so as to extend into a recessed area defined by the inner portion or liner of a door assembly (i.e., so as to allow the lower dish rack to extend outwardly of the forward opening of the tub to increase rack capacity). Due to, for example, structural limitations, the recessed area defined by the inner portion of the door assembly cannot be configured as wide as the tub, thus requiring the chamfers in the lower dish rack such that the lower dish rack can be accommodated by the recessed area. Thus, to maximize the capacity of a silverware basket configured to be received by one side of the lower dish rack, the silverware basket would have to include one or more chamfers or a large radius about the forward end of the lower dish rack to conform to the configuration of the lower dish rack.

Further, in this regard, some users desire silverware baskets having provisions, such as lids, for holding individual silverware items in a spaced-apart disposition during the dishwasher cleaning cycle. However, because of the extra time required to load individual silverware items in a spaced-apart manner when using such lids, other users may prefer silverware baskets without such lids, so as to allow the silverware items to be loaded without regard to the separation therebetween. In certain silverware baskets, if such lids are included, the lids are often configured to pivot about one side thereof (i.e., a forward or rearward end of the lid) to allow users to readily load silverware items by inserting multiple items therein at one time, without regard to separation therebetween. If the lid is configured to pivot from about the forward, rearward, or lateral sides of the silverware basket, the structure required for the lid to pivot may extend inwardly from that wall, and thus may reduce the useable area and/or hinder access to the silverware basket. In instances where the lid is required to pivot about the forward wall (i.e., toward the door assembly) of the silverware basket, the vertically extending lid, when the lid is pivoted to the open position, may hinder access to the silverware basket, thereby making it more difficult to load the silverware items in the silverware basket. In addition, a large chamfer or radius about the forward corner may preclude the ability of the lid to rotate at all, thus removing a possibly desired feature from the dishwasher. Furthermore, such lids are typically lost or otherwise misplaced if the user removes such lids to allow full use of the silverware basket capacity.

Thus, there exists a need for a basket assembly capable of conforming to various configurations of a dish rack, while also being configured to provide flexibility with regard to the loading of silverware items so as to accommodate user preferences.

BRIEF SUMMARY OF THE INVENTION

The above and other needs are met by the present invention which, according to one aspect, provides a basket assembly for a dishwashing appliance. The basket assembly comprises a plurality of wall members cooperating to form a compartment defining a compartment opening. A lid member is operably engaged with the compartment about the compartment opening. The lid member defines a lid plane and is configured to be pivotable about a pivot axis, disposed medially across the lid member and extending along the lid plane, between a first position with the lid member extending across the compartment opening, and a second position with the lid member extending substantially perpendicularly to the compartment opening.

Another aspect provides a dishwashing appliance, comprising a tub portion defining a forward access opening. A rack member is adapted to receive dishware therein and is movable into and out of the tub portion through the forward access opening. A basket assembly is configured to be received and supported by the rack member. The basket assembly comprises a plurality of wall members cooperating to form a compartment defining a compartment opening. The basket assembly further comprises a lid member operably engaged with the compartment about the compartment opening. The lid member defines a lid plane and is configured to be pivotable about a pivot axis, disposed medially across the lid member and extending along the lid plane, between a first position with the lid member extending across the compartment opening, and a second position with the lid member extending substantially perpendicularly to the compartment opening.

Aspects of the present invention thus provide significant advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present disclosure now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
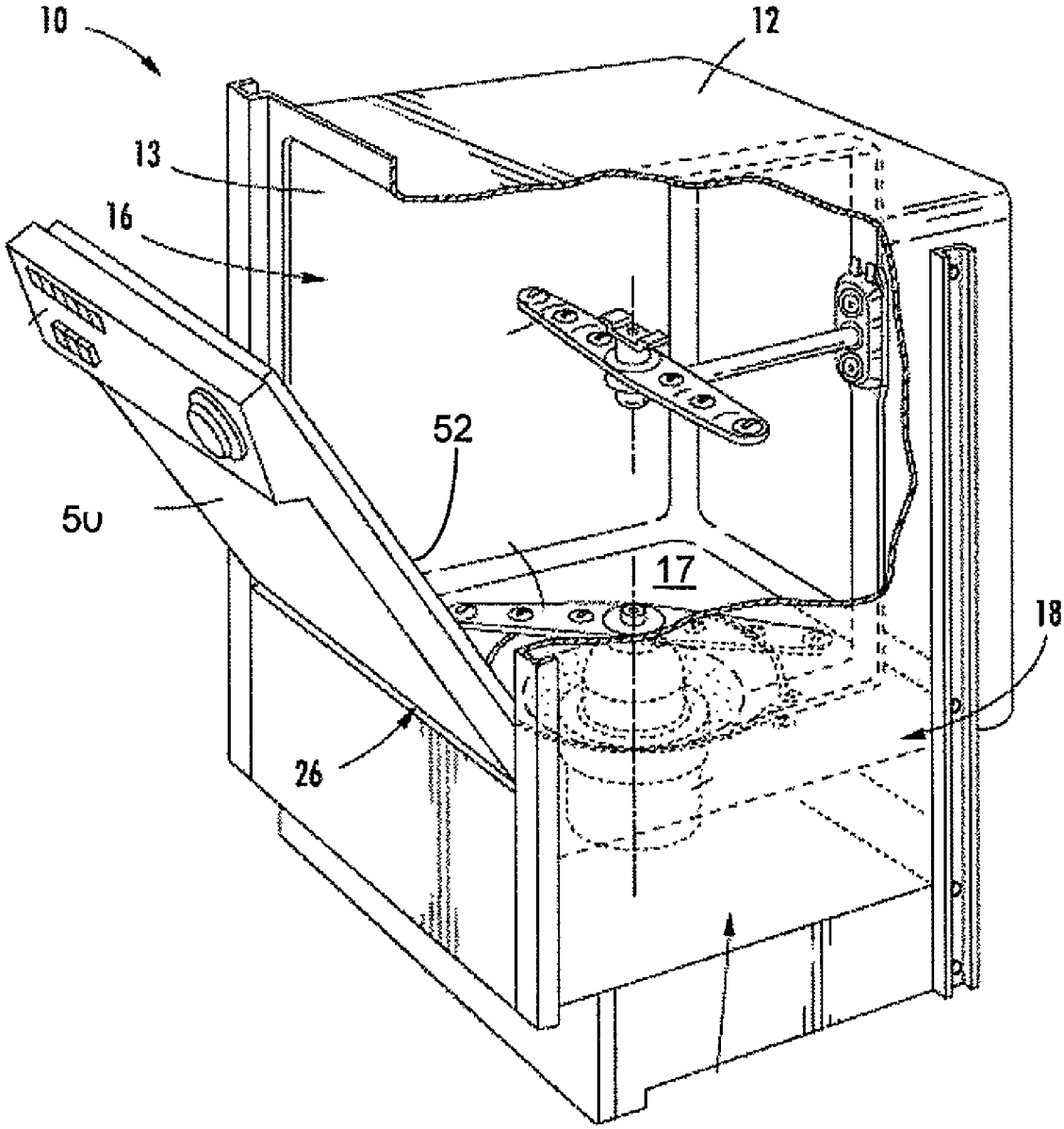
FIG. 1 is a perspective view of a dishwasher capable of implementing various embodiments of the present disclosure.

FIG. 1 illustrates one example of a dishwashing appliance, such as a dishwasher 10, capable of implementing various embodiments of the present invention. Such a dishwasher 10 typically includes a tub portion 12 (partly broken away in FIG. 1 to show internal details) having a plurality of walls (e.g., side wall 13, bottom wall 17) for forming an enclosure in which dishes, utensils, and other dishware or kitchenware may be placed for washing. The tub portion 12 may also define a forward access opening, generally designated as 16. A door assembly 50 may be pivotably engaged with the tub portion 12 about the lower end 18 thereof so as to selectively permit access to the interior of the tub portion 12. That is, a lower edge 26 of the door assembly 50 may be pivotably engaged (i.e., hinged) with the lower end 18 of the tub portion 12 such that the door assembly 50 is pivotable about the lower edge 26 thereof to provide access to the interior of the tub portion 12 through the forward access opening 16, and to cover and seal the forward access opening 16 when the dishwasher 10 is in operation.

The dishwasher 10 may also include movable lower and upper racks for holding the dishes, utensils, and dishware or kitchenware to be washed. That is, a dishwasher 10 typically includes a lower rack and an upper rack, both of which may be movable into and out of the tub portion 12 of the dishwasher 10 to facilitate loading and unloading of dishes and utensils. For example, and with reference to FIG. 2, the dishwasher may include a lower rack 40 located proximate the bottom wall 17 of the tub portion 12, and an upper rack (not shown) spaced vertically above the lower rack 40, both being movable into and out of the tub portion 12 when the door assembly 50 is in the open position (i.e., not blocking access to the interior of the tub portion 12). Each of the racks may be formed generally as a wire frame structure comprising, for example, a plurality of wires arranged to intersect one another at discrete points, at which the wires are secured to one another so as to define an open container configured to receive and support dishware or kitchenware therein and to allow dishwashing fluid to pass freely therethrough. For example, the lower rack 40 may include a reticulated or open network construction so that the dishwashing fluid and rinse fluid sprayed into the tub portion 12 can freely impinge upon the items supported on the lower rack 40 and drain back into the bottom of the tub portion 12.

In some instances, the lower rack 40 may have a bottom wall 42, a front wall 44 extending generally vertically upwardly from a front edge of the bottom wall 42, a rear wall 22 extending generally vertically upwardly from a rear edge of the bottom wall 42, and a pair of spaced side walls 48 extending generally vertically upwardly from opposite side edges of the bottom wall 42. More particularly, the bottom wall 42 of the lower rack 40 may be formed of spaced apart longitudinal rods 30 joined to spaced apart lateral rods 34. The end portions of the rods 30, 34 may be bent to form upwardly extending rods 32, defining the side walls 48, the front wall 44 and the rear wall 22. Bottom, center and upper horizontal rods or bands 23, 24, 25 may extend around the lower rack 40 and be joined to the vertical rods 32 to stiffen the side walls 48, front wall 44, and rear wall 22. A network of spaced apart, vertical tines or fingers may extend upwardly from the bottom wall 42 and from the junctions of the longitudinal and lateral rods 30, 34, to support dishes, utensils and other items placed in the lower rack 40. In operation, the door assembly 50 may be pivoted to an open position, thus allowing the lower rack 40 to be moved out of the tub portion 12 to facilitate loading and unloading of dishware when the door assembly 50 of the dishwasher 10 is in an "open" position. Generally, the lower rack 40 is at least partially supported by an interior portion 52 of the door assembly 50 when the door assembly 50 is in the open position, wherein the interior portion 52 faces the interior of the tub portion 12 when the door assembly 50 is in the closed position.

Figure 2:
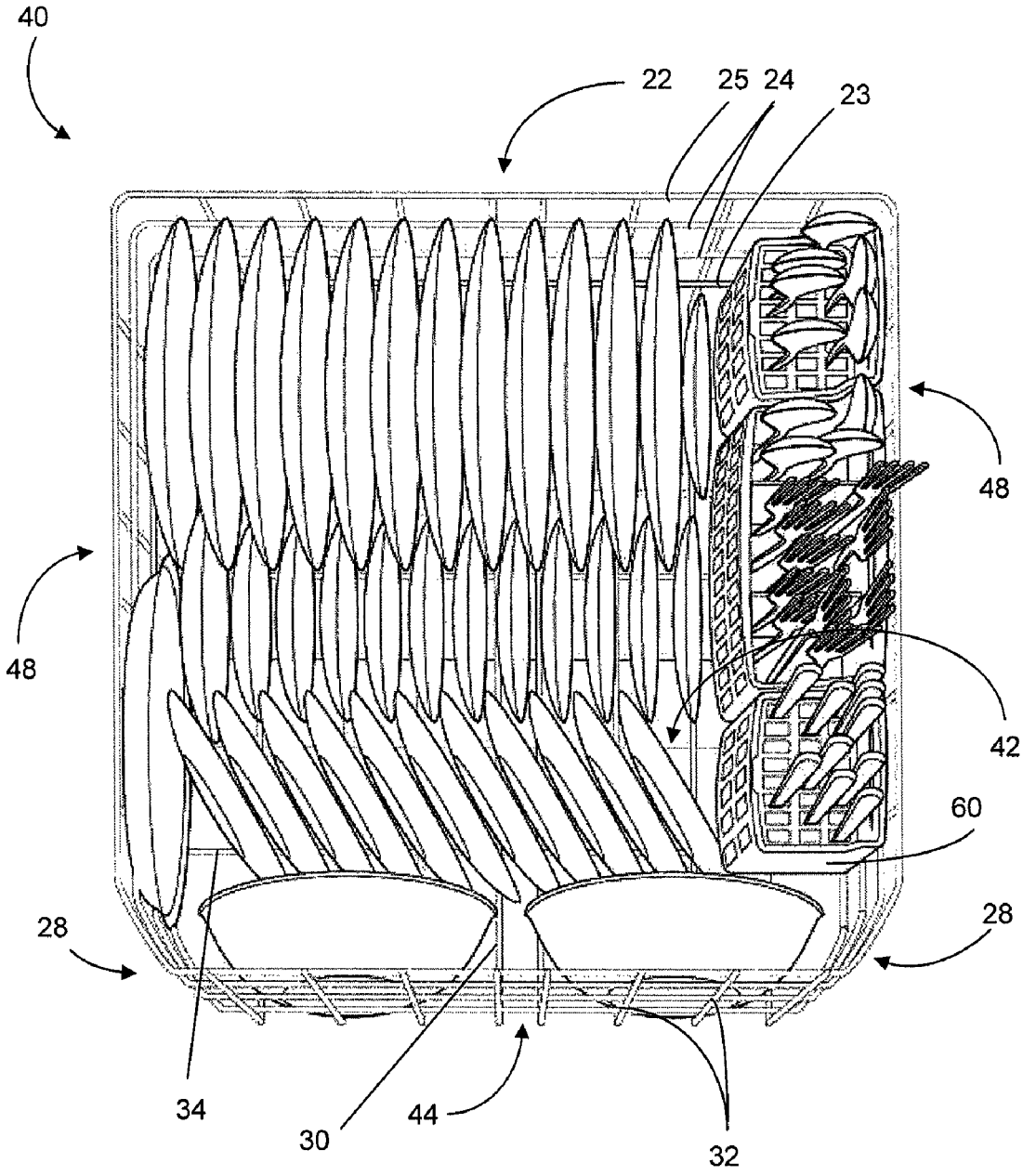
FIG. 2 is a perspective view of a dishwasher lower rack having a chamfered portion.

Furthermore, the lower rack 40 may have a pair of chamfer portions 28 extending from the side walls 48 of the lower rack 40 and converging toward the front wall 44 of the lower rack 40. Such chamfer portions 28 may permit the lower rack 40 to extend within a recessed portion of the door assembly 50 such that the capacity of the lower rack 40 may be increased. That is, the "narrowed" front wall 44 of the lower rack 40 may be configured so as to extend into a recessed area defined by the interior portion 52 or liner of the door assembly 50 (i.e., so as to allow the lower rack 40 to extend outwardly of the forward access opening 16 of the tub portion 12 to increase rack capacity), as described previously. In some instances, the lower rack 40 may be configured to receive and support a basket assembly, such as, for example, prior art silverware basket 60, mounted to or formed therein for holding knives, forks and spoons, wherein the silverware basket 60 may have several compartments for holding items of different size or shape. When mounted proximate to the forward portion of the lower rack 40 (i.e., where the side walls 48 and front wall 44 meet), silverware basket 60 would preferably be configured to correspond to the chamfer portion 28 so as to maximize the capacity of the lower rack 40, wherein the silverware basket 60 shown in FIG. 2 is not optimally configured as such (e.g., the rectangular shape of silverware basket 60 creates a somewhat unusable space between the chamfer portion 28 and the silverware basket 60). However, as described previously, previous silverware baskets having lids present problems when the silverware basket is configured so as to correspond with the chamfer portion 28.

Figure 3:
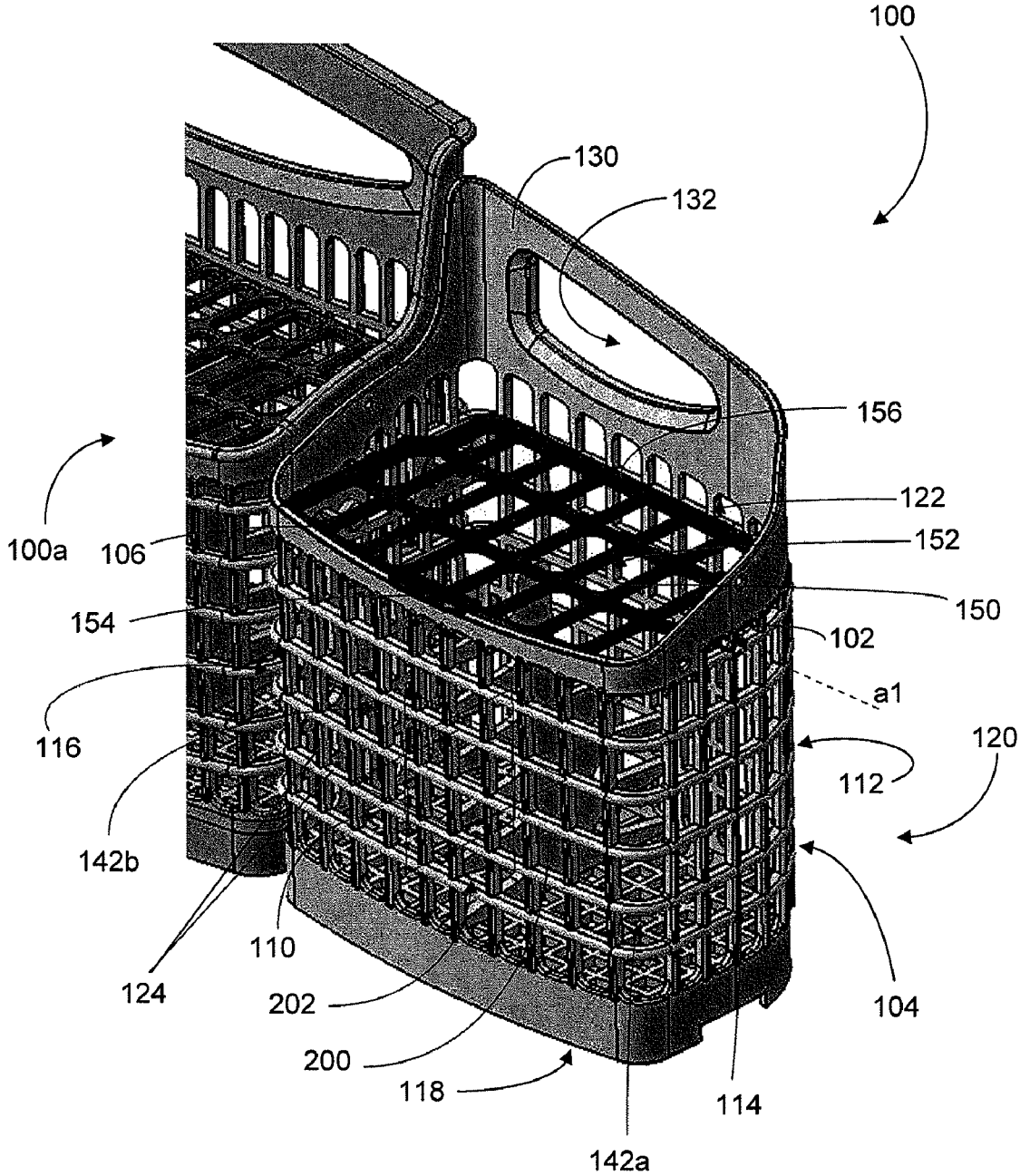
FIG. 3 is a perspective view of a basket assembly configured in accordance with an exemplary embodiment of the present invention, illustrating a lid member in a closed position.
Figure 4:
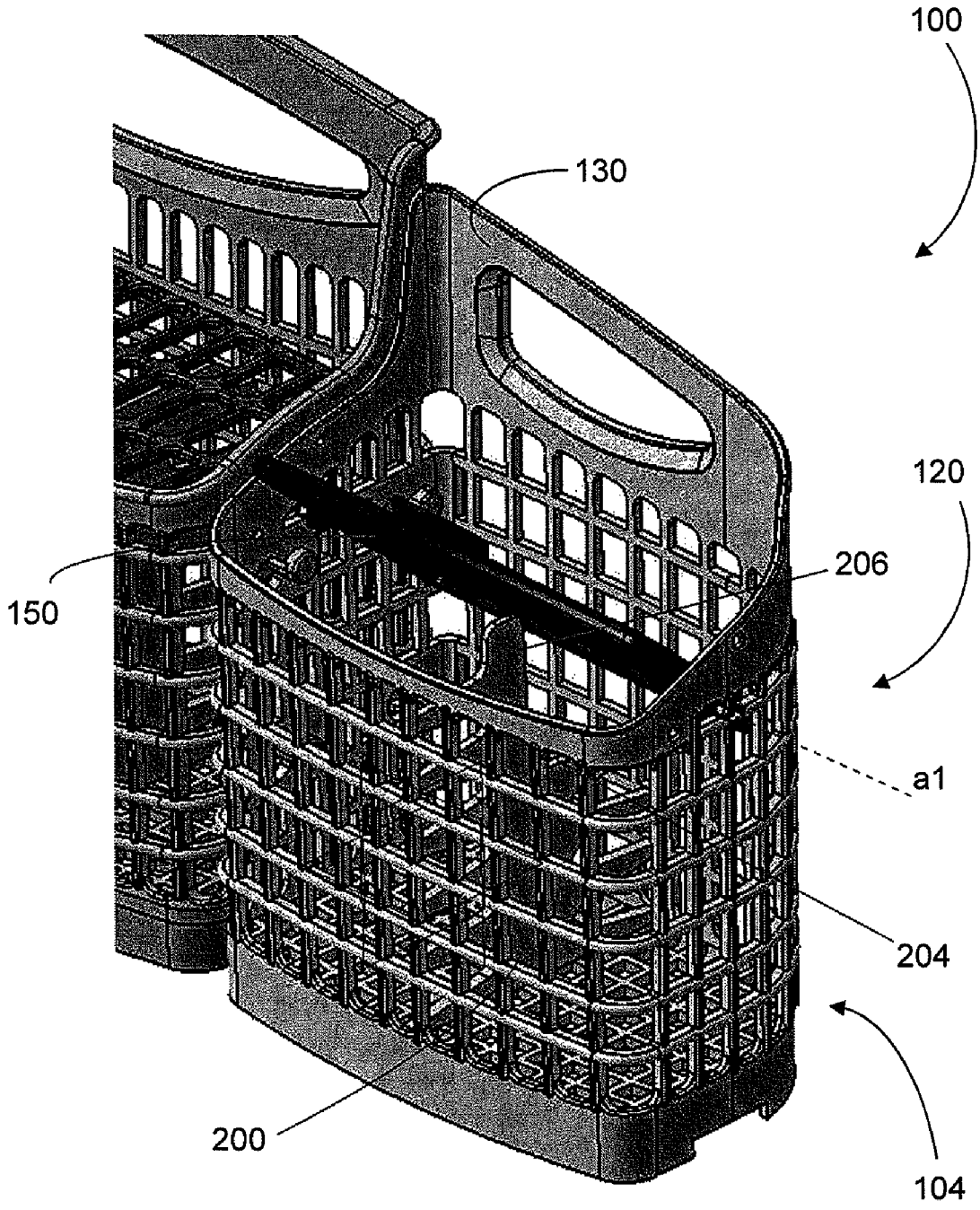
FIG. 4 is a perspective view of the basket assembly of FIG. 3, illustrating the lid member in an intermediate position.
Figure 5:
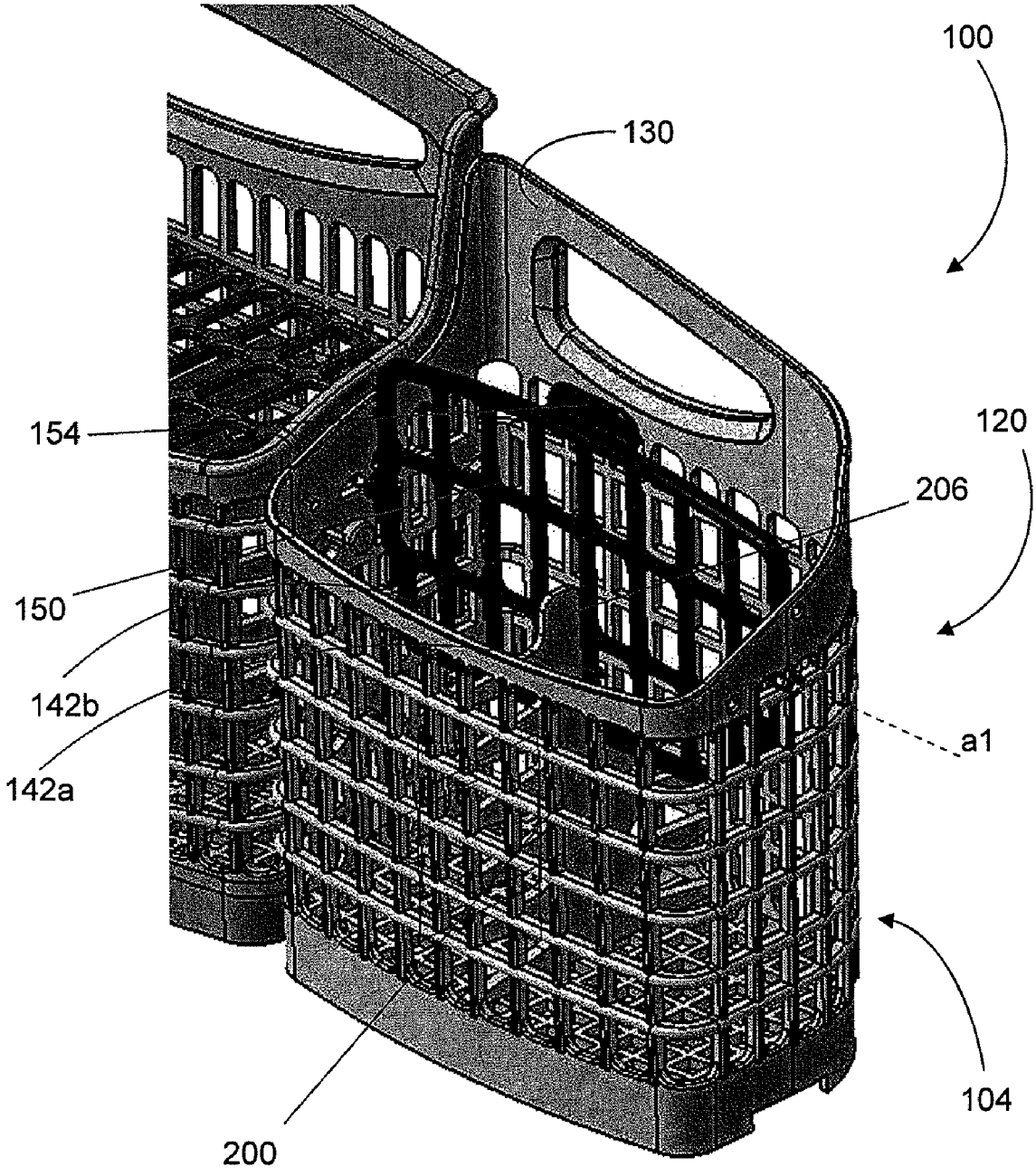
FIG. 5 is a perspective view of the basket assembly of FIG. 3, illustrating the lid member in an open position.

Referring to FIGS. 3-5, therein is shown a basket assembly 100 configured in accordance with an exemplary embodiment of the present invention. The basket assembly 100 may be used, for example, in a dishwasher, to hold items such as silverware, cooking utensils, and other kitchen implements and/or items of relatively small or moderate size. The basket assembly 100 generally includes a main body 102 and a lid member 150. The illustrated basket assembly 100 includes a supplemental basket 100*a* shown therewith. In this regard, the basket assembly 100 can be permanently or removably secured to other basket assemblies and/or, for example, to the lower rack within the dishwasher, with appropriate coupling structures.

The basket assembly 100 may include a plurality of wall members (e.g., forward wall 110, rear wall 112, side walls 114, 116, and bottom wall 118) that cooperate to form a compartment 120 generally defining an interior volume. The wall members further define a compartment opening 122 about the end opposite the bottom wall 118. The wall members 110, 112, 114, 116, 118 may be integrally formed, coupled, or otherwise secured to each other to form the compartment 120. The basket assembly 100 may also include a handle member 130, which may be integrally formed together with (or otherwise attached to) at least one of the wall members, such as with rear wall 112, and defining a grip portion 132. For example, the basket assembly 100, including the respective bottom wall 118, forward wall 110, rear wall 112, side walls 114, 116, and handle member 130, may be respectively formed by injection or rotational molding. Any or all of the wall members 110, 112, 114, 116, 118 may be formed as a latticework of interlinked cross-pieces 124 that are spaced apart from one another and thereby generally serving to contain objects larger than the spacing of adjacent cross-pieces, such as silverware, while allowing smaller objects, such as small food particles, and liquid to pass through the wall members 110, 112, 114, 116, 118. The basket assembly 100 can further include a lid member 150 that, together with the bottom wall 118 and other wall members, serve to define the volume of the compartment 120. The lid member 150 may be formed independently of the baskets, thereby allowing the lid member 150 to move relative to the basket to which it is coupled. The configuration of the lid member 150 and the manner in which the lid member 150 couples to the basket assembly 100, in some embodiments, is described in more detail below.

In some aspects, the wall members 110, 112, 114, 116, 118 may cooperate to form a main body 102, with two intersecting walls possibly defining at least one chamfer or non-linear portion 104. That is, the two intersecting wall members may define a chamfer or non-linear portion therebetween. In this regard, the basket assembly 100 may be appropriately configured to fit within a corresponding chamfered or large radius portion of the lower rack of a dishwasher so as to facilitate the maximization of the lower rack capacity. For example, the periphery of the basket assembly 100 may include the non-linear portion 104 such that the compartment 120 is substantially non-rectangular in lateral cross-section (i.e., from a plan view perspective). That is, the overall structure of the compartment is not rectangular when viewed through the compartment opening 122, but instead includes at least one of the non-linear portion 104 and a chamfer portion such as, for example, at one or more corners thereof. In this manner, the basket assembly 100 may correspond to the chamfer (e.g., chamfer portion 28 illustrated in FIG. 2) or large radius portion of the lower rack in a capacity-maximizing manner, both with respect to the basket assembly 100 and the lower rack. Further, the basket assembly 100 may include a rim portion 106 disposed about the top edge of the front wall 110, rear wall 112, and side walls 114, 116 proximate to and, in some instances, defining the compartment opening 122. In instances where the basket assembly 100 includes the handle member 130, the rim portion may extend about the upper edge of the handle member 130 which may be integrally formed with, for example, the rear wall 112 (depending on the positioning of the handle member 130). One skilled in the art will appreciate, however, that the handle member 130 may have many different configurations, and may be operably engaged with at least one of the walls of the basket assembly, as necessary or desirable.

The basket assembly 100 further includes the lid member 150, which may be pivotably coupled to the main body 102 (e.g., side walls 114, 116) by a coupling structure such as, for example, by an axial component or structure configured to rotatably interact with the side walls 114, 116 of the compartment 120. However, in other instances, the coupling structure may be associated with the compartment 120 rather than the lid member 150. The lid member 150 defines a lid plane and includes a pivot axis a1 about which the lid member 150 is capable of pivoting. In some instances, the pivot axis a1 may be disposed medially across the lid member 150 and extend along the lid plane. The lid member 150 may be configured to pivot between a closed (or "first") position (FIG. 3), where the lid member 150 extends across the compartment opening 122, and an open (or "second") closed position (FIG. 5), where the lid member 150 extends substantially perpendicularly to the compartment opening 122. The lid member 150 may pivot approximately 90° to move between the open and closed positions (see, e.g., FIG. 4) such that the lid member 150 pivots between a substantially horizontal position and a substantially vertical position with respect to the compartment 120 and the compartment opening 122 defined thereby. The lid member 150 may further define a first lateral dimension thereof extending between the side walls 114, 116 and a second lateral dimension extending between the front wall 110 and the rear wall 112.

According to some embodiments, the pivot axis a1 may be disposed along or near the center of the lid member 150. In this manner, the lid member 150 may readily rotate between the open and closed positions, even when the basket assembly 100 includes a large chamfer or radius portion in one or more corners thereof. In this manner, as illustrated in FIG. 5, the lost area in the basket assembly 100 may be reduced to the thickness of the lid member 150 itself, when the lid member 150 is in the open position, because silverware or other articles may be placed on both sides thereof, without having to avoid a lid pivoting structure associated with one of the vertically extending walls 110, 112, 114, 116. Furthermore, hindered access to the basket assembly 100 may be reduced in some instances since, when the lid member 150 is pivoted to the open position, only about half or less than half of the width thereof extends above the level of the basket assembly 100/compartment opening 122. As such, some embodiments of the present invention, as implemented, may help to maximize the capacity to the lower rack of the dishwasher by providing a use for the space created by a chamfer or large radius portion of the lower rack, while also providing improved access to the basket assembly 100 for inserting and removing silverware or other articles by removing lid pivoting structures associated with wall members of the basket assembly 100.

In the closed position, the lid member 150 may be used to maintain articles (e.g., silverware) in a spaced-apart manner. In this regard, the lid member 150 may include a plurality of article receiving openings 152 configured to receive an article therethrough for insertion into the interior volume of the basket assembly 100. That is, the article receiving openings 152 may be sized, for example, to accept common silverware. The article receiving openings 152 may or may not be uniform in size. When the lid member is in the closed position, each of the article receiving openings 152 can act as a seating area for portions of the supported articles to allow the articles to be spaced-apart in various positions within the compartment 120. Spacing apart the articles at different positions within the compartment 120 by using the article receiving openings 152 can help maximize the surface area of the silverware or other supported articles exposed to dishwashing or rinse fluid during the dishwashing procedure. Moreover, separating the silverware or other supported articles can help circulate air over a larger surface area of the articles; thereby reducing the duration of the drying cycle and increasing the effectiveness of the washing and drying procedures.

According to some aspects, the lid member 150 may further include a detent member 154, which may serve several purposes. First, the detent member 154 may prevent the lid member 150 from rotating beyond the closed position, when rotating away from the opened position. That is, the detent member 154 may interact with, for example, the rim portion 106 about the forward wall 110 by extending therebeyond such that the detent member 154 prevents the lid member 150 from moving further in the direction toward the bottom wall 118 when pivoted from the open position. Next, the detent member 154 may act as a coupling structure to maintain the lid member 150 in the closed position when pivoted thereto. For example, the detent member 154 may interact with the rim portion 106 of the forward wall 110 in an interference manner such that an upward force from the user is needed to decouple the lid member 150 from the forward wall 110. Finally, by extending beyond the forward wall 110, the detent member 154 may provide a grasp portion that facilitates gripping or grasping for a user to move the lid member 150 between the open and closed positions. In other instances, the lid member 150 may be configured in an interference fit with at least one of the walls/wall members defining the compartment opening 122 (i.e., extending further from the pivot axis a1 than the distance between the pivot axis a1 and the at least one of the wall members) to prevent pivoting of the lid member 150 beyond the first position when rotating away from the second position.

In some instances, the basket assembly 100 may include one or more optional divider members 200 or partitions that serve to at least partially separate the basket assembly 100 into multiple compartments. That is, the divider member 200 can optionally act to divide the interior of the compartment 120 into various interior area portions/sections. As shown in FIG. 3, a first interior area portion 142*a* can be defined by the bottom wall 118, forward wall 110, rear wall 112, side wall 114, and divider member 200. A second interior area portion 142*b* can be defined by the bottom wall 118, forward wall 110, rear wall 112, side wall 116, and divider member 200. In some instances, the divider member 200 may be coupled to the forward wall 110 and rear wall 112 so as to extend therebetween to substantially bisect the compartment 120. The divider member may further extend from the bottom wall 118 to about the compartment opening 122. Further, the divider member 200 may be configured so as to permit dishwashing fluid to pass therethrough. For example, the divider member 200 may include a plurality of recessed portions 202 or other openings to permit the free flow of dishwashing or rinse fluid therethrough.

According to some embodiments, the divider member 200 may further be configured to permit rotation of the lid member 150. For example, due to the perpendicular relationship between the divider member 200 and the lid member 150 when in the closed position, the divider member may be appropriately configured to account for the rotation of the lid member 150 within the interior of the compartment 120. Furthermore, the divider member 200 may be configured to interact with the lid member 150 for maintaining the lid member 150 in the substantially vertical open position. For example, the divider member 200 may include an interference portion, such as, for example, an edge 204, which interacts with a portion of the divider member 200 to provide a resistive force thereto for retaining the lid member 150. For example, as an end 156 of the lid member 150 moves arcuately toward the divider member 200, the end 156 may eventually contact the substantially horizontally disposed edge 204 of the divider member 200, wherein the friction therebetween keeps the lid member 150 in the open position. In some instances, both the lid member 150 and the divider member 200 may be constructed of a deformably resilient material that facilitates the interference interaction therebetween. Furthermore, the divider member may include a vertically disposed wall edge 206 that may alternatively interact with the lid member 150 to prevent the lid member 150 from rotating beyond the open (second) position when pivoted away from the closed (first) position. In other instances, the weight of the lid member 150 may be distributed such that the lid member 150 is maintained in the open and closed positions without the assistance of interfering structures or other position-maintaining structures. That is, the weight of the lid member 150 may be appropriately distributed to keep the lid member 150 in the substantially horizontal closed position when desired and then, when rotated to the open position, maintained in the substantially vertical open position due to the appropriate weight distribution.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A basket assembly for a dishwashing appliance, comprising:

a plurality of wall members cooperating to form a compartment defining a compartment opening;

a lid member operably engaged with the compartment about the compartment opening, the lid member defining a lid plane and being configured to be pivotable about a pivot axis, disposed medially across the lid member and extending along the lid plane, between a first position with the lid member extending across the compartment opening, and a second position with the lid member extending substantially perpendicularly to the compartment opening; and a divider member operably engaged with at least one of the wall members and extending across and at least partially dividing the compartment, wherein the lid member is configured to interact with the divider member in the second position so as to at least partially subdivide the compartment.

2. A basket assembly according to claim 1 wherein two intersecting wall members cooperate to define one of a chamfer and non-linear portion therebetween.

3. A basket assembly according to claim 1 wherein the divider member is configured to interact with the lid member to prevent pivoting of the lid member away from the first position beyond the second position.

4. A basket assembly according to claim 3 wherein the divider member is configured to interact with the lid member to facilitate positioning of the lid member in the second position.

5. A basket assembly according to claim 1 wherein the lid member is further configured in an interference fit with at least one of the wall members defining the compartment opening to prevent pivoting of the lid member away from the second position beyond the first position.

6. A basket assembly according to claim 1 further comprising a coupling structure configured to pivotably couple the lid member to at least one of the wall members defining the compartment, the coupling structure defining the pivot axis.

7. A basket assembly according to claim 1 wherein the lid member defines a plurality of openings configured to receive articles therethrough so as to maintain the articles received therein in a spaced-apart configuration and to permit washing fluid to flow therethrough into the compartment.

8. A basket assembly according to claim 1 wherein the lid member includes opposing ends disposed on either side of and extending substantially parallel to the pivot axis, the ends defining a lid width therebetween, and wherein no more than half of the lid width extends out of the compartment opening when the lid member is positioned in the second position.

9. A basket assembly according to claim 1 further comprising a handle member operably engaged with at least one of the wall members, the handle member defining a grip portion.

10. A dishwashing appliance, comprising:

a tub portion defining a forward access opening;

a rack member adapted to receive dishware therein and being movable into and out of the tub portion through the forward access opening; and a basket assembly configured to be received and supported by the rack member, the basket assembly comprising:

a plurality of wall members cooperating to form a compartment defining a compartment opening;

a lid member operably engaged with the compartment about the compartment opening, the lid member defining a lid plane and being configured to be pivotable about a pivot axis, disposed medially across the lid member and extending along the lid plane, between a first position with the lid member extending across the compartment opening, and a second position with the lid member extending substantially perpendicularly to the compartment opening; and a divider member operably engaged with at least one of the wall members and extending across and at least partially dividing the compartment, wherein the lid member is configured to interact with the divider member in the second position so as to at least partially subdivide the compartment.

11. A dishwashing appliance according to claim 10 wherein two intersecting wall members of the basket assembly cooperate to define one of a chamfer and non-linear portion therebetween.

12. A dishwashing appliance according to claim 10 wherein the divider member is configured to interact with the lid member to prevent pivoting of the lid member away from the first position beyond the second position.

13. A dishwashing appliance according to claim 12 wherein the divider member is configured to interact with the lid member to facilitate positioning of the lid member in the second position.

14. A dishwashing appliance according to claim 10 wherein the lid member is further configured in an interference fit with at least one of the wall members defining the compartment opening to prevent pivoting of the lid member away from the second position beyond the first position.

15. A dishwashing appliance according to claim 10 wherein the basket assembly further comprises a coupling structure configured to pivotably couple the lid member to at least one of the wall members defining the compartment, the coupling structure defining the pivot axis.

16. A dishwashing appliance according to claim 10 wherein the lid member defines a plurality of openings configured to receive articles therethrough so as to maintain the articles received therein in a spaced-apart configuration and to permit washing fluid to flow therethrough into the compartment.

17. A dishwashing appliance according to claim 10 wherein the lid member includes opposing ends disposed on either side of and extending substantially parallel to the pivot axis, the ends defining a lid width therebetween, and wherein no more than half of the lid width extends out of the compartment opening when the lid member is positioned in the second position.

18. A dishwashing appliance according to claim 10 wherein the basket assembly further comprises a handle member operably engaged with at least one of the wall members, the handle member defining a grip portion.

19. A basket assembly for a dishwashing appliance, comprising:

a plurality of wall members cooperating to form a compartment defining a compartment opening;

a lid member operably engaged with the compartment about the compartment opening, the lid member defining a lid plane and being configured to be pivotable about a pivot axis, disposed medially across the lid member and extending along the lid plane, between a first position with the lid member extending across the compartment opening, and a second position with the lid member extending substantially perpendicularly to the compartment opening; and a divider member operably engaged with at least one of the wall members and extending across and at least partially dividing the compartment, wherein the divider member is configured to interact with the lid member to prevent pivoting of the lid member away from the first position beyond the second position.

* * * * *